United States Patent [19]

Hotta

[11] Patent Number: 4,509,645

[45] Date of Patent: Apr. 9, 1985

[54] PORTABLE CONSTANT TEMPERATURE BOX

[75] Inventor: Masashi Hotta, Osaka, Japan

[73] Assignee: Shimano Industrial Company Limited, Osaka, Japan

[21] Appl. No.: 532,169

[22] Filed: Sep. 14, 1983

[30] Foreign Application Priority Data

| | | | |
|---|---|---|---|
| Sep. 22, 1982 | [JP] | Japan | 57-143712[U] |
| Nov. 30, 1982 | [JP] | Japan | 57-182134[U] |
| Dec. 4, 1982 | [JP] | Japan | 57-183819[U] |

[51] Int. Cl.[3] ..... A45C 11/20

[52] U.S. Cl. ..... 206/545; 206/546; 229/31 R; 220/DIG. 9; 220/DIG. 10; 383/110

[58] Field of Search ..... 206/545, 546; 220/DIG. 9, DIG. 10; 229/31 R; 383/110, 97

[56] References Cited

U.S. PATENT DOCUMENTS

| | | | |
|---|---|---|---|
| 265,985 | 10/1882 | Seabury | 229/31 R |
| 692,564 | 2/1902 | Webb | 229/31 R |
| 1,253,193 | 1/1918 | Hill | 229/31 R |
| 2,123,031 | 7/1938 | Weiner | 383/110 |
| 2,295,508 | 9/1942 | Altheimer | 229/31 R |
| 2,386,905 | 10/1945 | Meitzen | 229/31 R |
| 2,485,643 | 10/1949 | Norquist | 229/31 R |
| 3,097,782 | 7/1963 | Koropatkin et al. | 206/546 |
| 3,182,913 | 5/1965 | Brian | 229/31 R |
| 3,262,283 | 7/1966 | Taylor | 383/110 |
| 3,399,819 | 9/1968 | Rehnie et al. | 229/31 R |
| 3,567,106 | 3/1971 | Anderson | 229/31 R |
| 4,091,852 | 5/1978 | Jordan et al. | 383/110 |
| 4,429,793 | 2/1984 | Ehmann | 206/545 |

FOREIGN PATENT DOCUMENTS

| | | | |
|---|---|---|---|
| 263035 | 2/1964 | Australia | 229/31 R |
| 445694 | 11/1912 | France | 229/31 R |
| 17324 | of 1895 | United Kingdom | 229/31 R |
| 23614 | of 1895 | United Kingdom | 229/32 |
| 585216 | 2/1947 | United Kingdom | 229/32 |

*Primary Examiner*—William T. Dixson, Jr.
*Assistant Examiner*—Brenda J. Ehrhardt
*Attorney, Agent, or Firm*—Stevens, Davis, Miller & Mosher

[57] ABSTRACT

A portable constant temperature box is formed of a box body and a lid, the box body being formed of a square bottom wall of adiabatic material, four side walls, and an external sheet. The side walls are connected to the bottom wall such that they can unfold and rise and the external sheet forms foldable connecting portions for connecting the side walls. A pair of retainers fix the connecting portions detachably to the side walls to thereby hold the side walls to rise upright respectively.

1 Claim, 17 Drawing Figures

PORTABLE CONSTANT TEMPERATURE BOX

FIELD OF THE INVENTION

This invention relates to a portable constant temperature box, and more particularly to a constant temperature box having a heat insulating performance and portable mainly for a picnic or fishing.

BACKGROUND OF THE INVENTION

Generally, a constant temperature box used for a picnic or fishing comprises inner and outer casings of stainless steel, which each comprise a square bottom and four side walls rising from four side edges of the bottom and are laid one on the other. Interposed between the casings is an adiabatic material mainly of foam styrol.

Such constant temperature box using the inner and outer casings of expensive stainless steel is not only larger in weight but also expensive to produce, and also requires three constituents of inner and outer casings and adiabatic material to thus increase the number of parts and take much time for machining and assembly, thereby increasing the manufacturing cost. Furthermore, the box not-unfolded is bulky for storing or transportation to result in a great expense therefor.

SUMMARY OF THE INVENTION

In the light of the above problems, this invention has been designed. An object of the invention is to provide a portable constant temperature box which is lightweight, inexpensive to produce, unfolded or folded for storing or transportation, and available as a sheet when unfolded.

A constant temperature box of the invention comprises a box body and a lid of adiabatic material, the box body comprising a square bottom wall of adiabatic material and four side walls of adiabatic material connected to four side edges of the bottom wall in relation of enabling to stand upright therefrom or be unfolded. A square sheet covers the outer surfaces of the bottom and side walls and connects the side edges thereof so that four corners of the sheet positioned between the side edges of the respective adjacent side walls constitute connecting portions for connecting each side wall. Each connecting portion is foldable in triangle and so constructed that the free ends of each pair of connecting portions when folded overlap each other on a pair of opposite side walls, the free ends having through bores which are coincident with each other when the corners of the external sheet are folded. The pair of side walls, on which the free ends are overlapped, each have one retainer which is coincident with each throughbore and which fixes the connecting portions detachably to the side walls when raised, so as to hold each side wall in a raised position.

Accordingly, the box body, when each side wall rises, is box-like-shaped to form together with the lid the constant temperature box and is sheet-like-shaped when each side wall is unfolded to be available as a carpet and is not bulky, thereby enabling effective utilization of space when stored or transported.

Furthermore, each side wall can be kept upright by simple operation such that each pair of connecting portions are folded and overlapped on the pair of opposite side walls are fixed by the retainers. The retainers are released only to enable each side wall to be unfolded outwardly around the bottom wall, in which the contents in the box need not be removed, whereby the contents are available immediately after unfolding.

In addition, each retainer used in this invention mainly comprises a hook and eye, or a rotary retainer comprising a base and an elongate thumb-nut, the retainers not being defined particularly in type.

The side walls may alternatively be connected to the bottom by use of thin hinges. Furthermore, an internal sheet may be used together with the external sheet so that two sheets may cover both sides of bottom wall and side walls.

Both the internal and external sheets are mainly stuck to connect with the bottom and side walls. Also, the lid may be separate from the body, but preferably is connected to one side wall by use of thin hinges or the external sheet.

These and other objects of the invention will become more apparent in the detailed description and examples which follow.

DETAILED DESCRIPTION OF THE INVENTION

Figure 1:
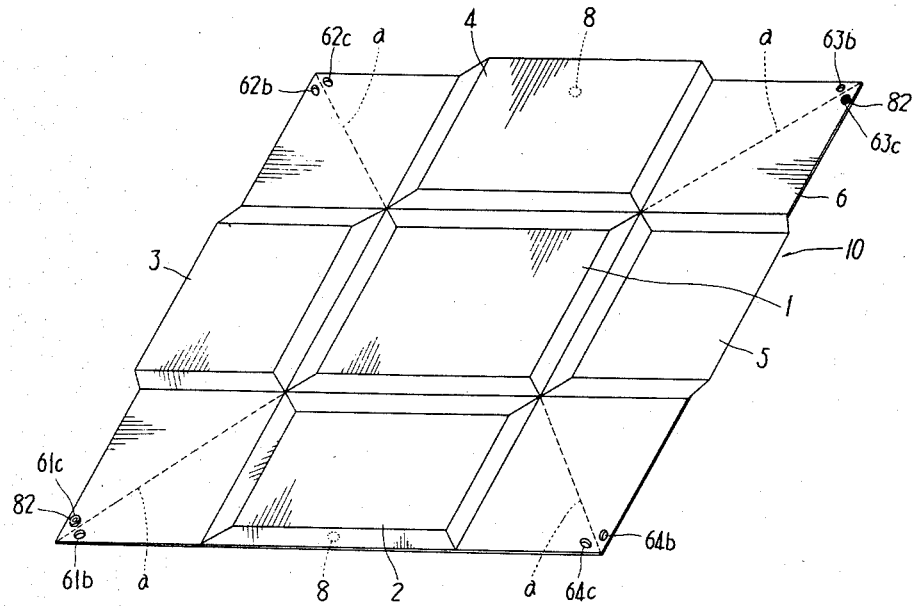
FIG. 1 is a perspective view of an embodiment of a constant temperature box of the invention, which is unfolded.
Figure 2:
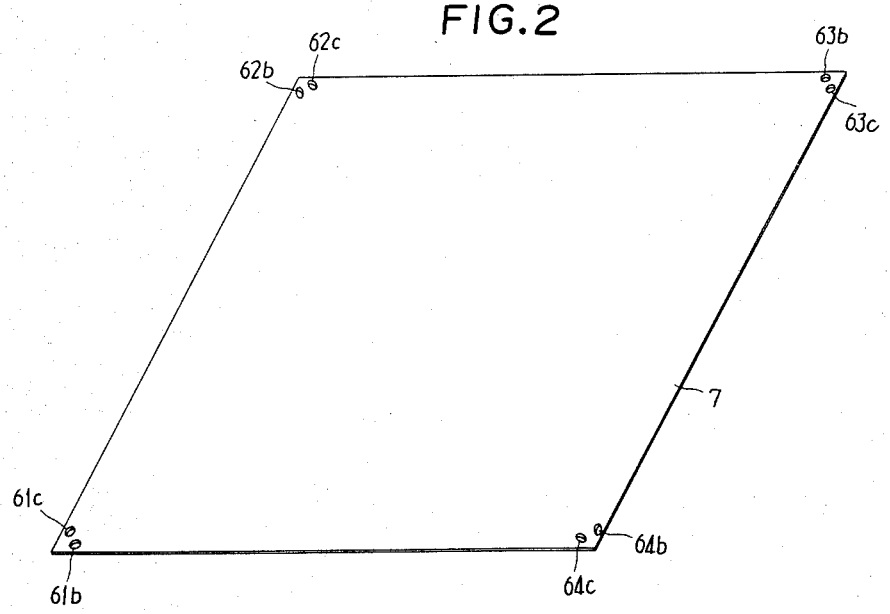
FIG. 2 is a perspective view of an internal sheet only.

FIGS. 1 through 6 show a constant temperature box of the invention comprising a box body 10 and a lid 20 separate therefrom. The box body 10 comprises a rectangular bottom wall 1 and four rectangular side walls 2, 3, 4 and 5 connected to four side edges of bottom wall 1 in relation of unfolding or rising, the walls 1 through 5 being separate from each other and formed of adiabatic material, such as foam polystyrene resin or foam styrol resin, and larger in thickness (for example 20 to 40 mm). The side walls 2 through 5, as shown in FIG. 1, are disposed at four sides of bottom wall 1. All the walls 1 through 5 are covered at the outer surfaces with an external square sheet 6 formed of, for example, vinyl chloride, and at the inner surfaces with an internal square sheet 7 formed of, for example, aluminum foil or vinyl chloride, as shown in FIG. 2, with both the sheets 6 and 7 being stuck to all the walls 1 through 5 by an adhesive or thermal bonding to thereby connect the respective side walls 2 through 5 to the bottom wall 1 in relation of freely unfolding or rising, all the walls 1 through 5, when unfolded, being usable as one carpet.

Figure 3:
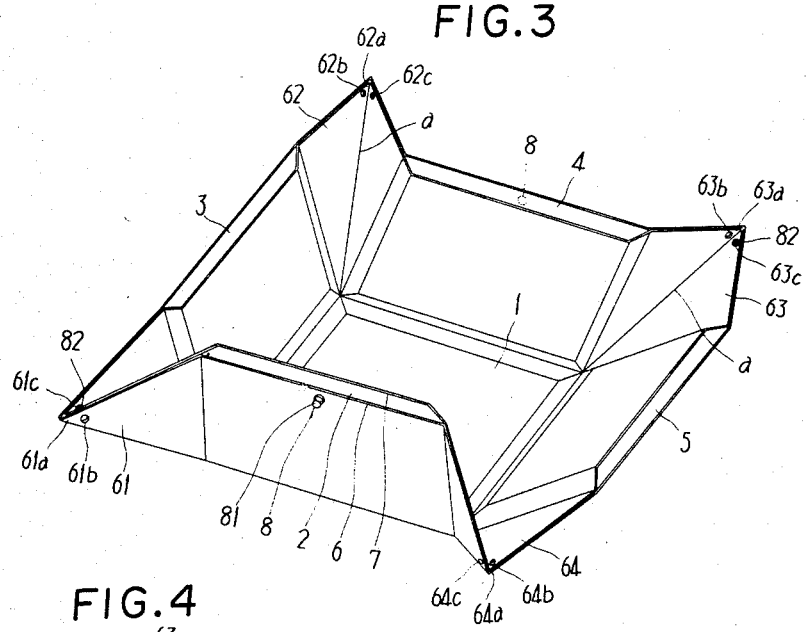
FIG. 3 is a perspective view of the box body during assembly.

The external and internal sheets 6 and 7 are square enough to cover and sandwich therebetween the unfolded walls 1 through 5 to be stuck by a bonding means, such as an adhesive. The sheets 6 and 7 are bonded at four corners with each other by a bonding means, such as an adhesive, as shown in FIG. 3, so that the four corners are formed in connecting portions 61, 62, 63 and 64 between the adjacent side walls 2 and 3, 3 and 4, 4 and 5, and 2 and 5 respectively.

The connecting portions 61 through 64 are provided with creases a connecting four corners of sheets 6 and 7 to those of bottom wall 1, thereby being foldable in triangle. The free ends 61*a* and 64*a* at the folded connecting portions 61 and 64 are overlapped with each other on the side wall 2, and the free ends 62*a* and 63*a* at the folded portions 62 and 63 are overlapped on the side wall 4. Free ends 61*a* through 64*a* have through bores 61*b* and 61*c* in alignment with each other and through bores 62*b* and 62*c*, 63*b* and 63*c*, and 64*b* and 64*c*, in alignment with each other respectively. Retainers 8 are provided at the central portions of opposite side walls 2 and 4 and detachably fix the free ends 61*a* and 64*a* and those 62*a* and 63*a* overlapped with each other onto the side walls 2 and 4 to thereby keep the respective side walls raised.

The respective connecting portions 61 through 64 are folded and extend along the outer surfaces of opposite side walls 2 and 4 as shown. Alternatively, the portions 61 through 64 may extend along the inner surfaces of the same, or along the outer or inner surfaces of opposite side walls 3 and 5.

The retainers 8 shown in FIGS. 1 through 7 each comprise a male hook 81 or projection 81*a* and a female hook 82 or eye 82*a*, the projections 81*a* being mounted on the side walls 2 and 4. In this case, the male and female hooks 81 and 82 are disconnected from each other, and the through bores 61*b* through 64*c* at the portions 61 through 64 are fitted onto the projections 81*a*. Then, the projections 81*a* of male hooks 81 are fitted into the eyes 82*a* of female hooks 82, thereby fixing the connecting portions 61 and 64 to the side wall 2 and those 62 and 63 to the side wall 4. In this case, the female hooks 82 are preferably fixed into the through bores 61*c* and 63*c* at the connecting portions 61 and 63 at one side of overlapping free ends of portions 61 and 64, and 62 and 63.

Figure 9:
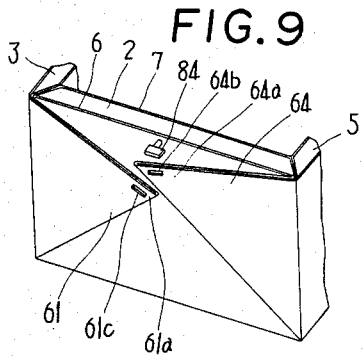
FIG. 9 is a partial perspective view of the box body using the retainer in FIG. 8.
Figure 8:
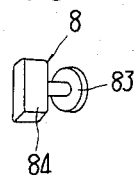
FIG. 8 is a perspective view of an example of the retainer.

Alternatively, the retainer 8 may use a rotary retainer comprising a base 83 and a block 84 which is elongate and supported rotatably to the base 83 as shown in FIG. 8. The through bores 61*b* through 64*c*, as shown in FIG. 9, are made elongate larger in length than the block 84. The retainers 8 are fixed at the bases 83 to the side walls 2 and 4 respectively. The blocks 84 are aligned with the through bores 61*b* to 64*c* and inserted therein and then turned at an angle of 90°, thereby fixing the connecting portions 61 through 64 to the side walls 2 and 4 respectively.

Figure 10:
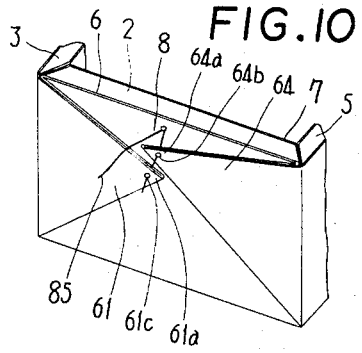
FIG. 10 is a partial perspective view of the box body using another example of retainer.

Also, the retainer 8 may use two springs 85 as shown in FIG. 10. In this case, one string 85 is inserted into the through bores 61*b* and 64*c* and tied with the other to thereby fix the connecting portions 61 through 64 to the side walls 2 and 4 respectively.

Figure 12:
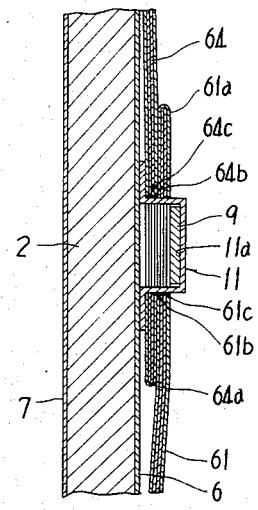
FIG. 12 is an enlarged sectional view of the fixed portion by use of the retainer in FIG. 11.
Figure 11:
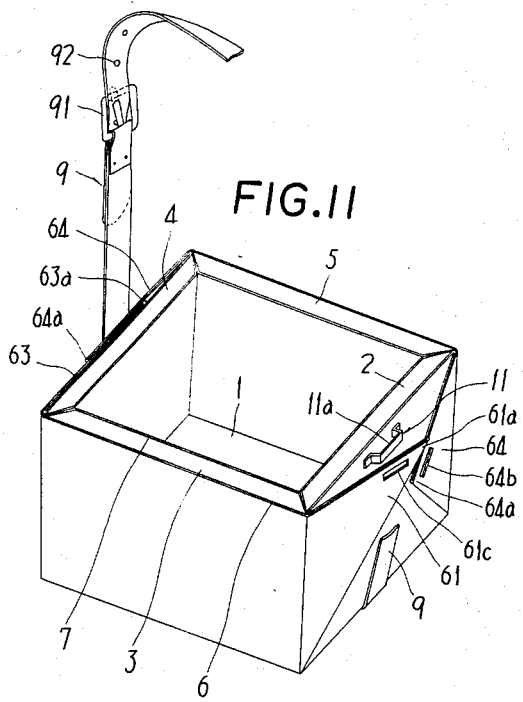
FIG. 11 is a perspective view of the box body using still another example of retainer.

Furthermore, the retainer 8 may alternatively use a shoulder band 9 as shown in FIGS. 11 and 12. In this case, holders 11 for the band 9 are mounted on the side walls 2 and 4 respectively and are spaced at the bodies largely from the side walls 2 and 4, and the through bores 61*b* to 64*c* are made large enough to be inserted onto the holders 11. The through bores 61*b* to 64*c* are inserted onto the holders 11, and then the band 9 is inserted into an insertion gap 11*a* to thereby fix the connecting portions 61 through 64 to the side walls 2 and 4.

The shoulder band 9, as shown in FIG. 11, has at one end a retainer 91 and bores 92 at the other end, one bore 92 being retained to the retainer 91 for carrying the box by the looped band 9. The other free end of band 9 is released from the retainer 91 and inserted into the insertion gap 11*a* at holder 11.

Figure 4:
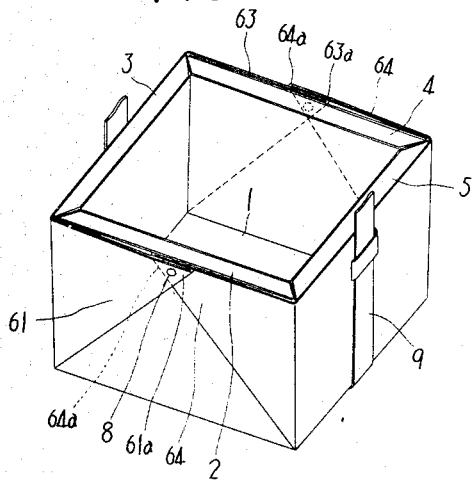
FIG. 4 is a perspective view of the same in assembly.
Figure 5:
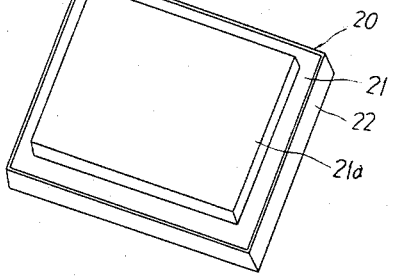
FIG. 5 is a perspective view of a lid only.
Figure 6:
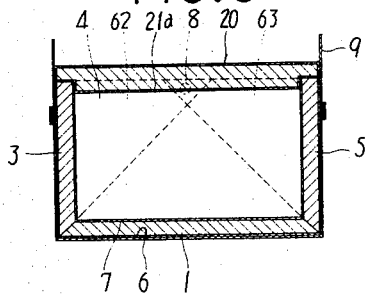
FIG. 6 is a sectional view of the box body into which the lid is fitted.
Figure 7:
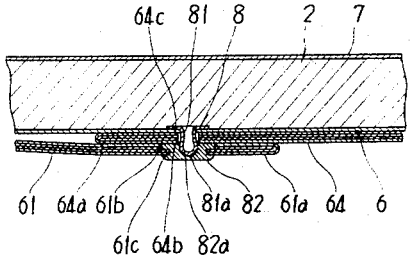
FIG. 7 is an enlarged sectional view of a portion fixed by a retainer.

In addition, the walls 1 through 5 are tilted at the side edges at an angle of 45° as shown in FIG. 4, so that when the side walls 2 to 5 rise, the tilted edges are brought into close contact with each other, the side edges being not indispensable to be tilted.

The lid 20 is formed of flat and square wall 21 of adiabatic material and has at the inner surface of wall 21 a square fitting 21*a* and lid 20 is coated at the outer surface with an external sheet 22 of vinyl chloride.

The constant temperature box constructed as above-mentioned is assembled in such a manner that the side walls 2 to 5, as shown in FIG. 3, are raised and, the connecting portions 61 and 64 are folded outside the side wall 2 and those 62 and 63 outside the side wall. Free ends 61*a* and 64*a* and those 62*a* and 63*a* are overlapped to be fixed to the side walls 2 and 4 by use of retainers 8 respectively, thereby keeping the side walls 2 through 5 upright and containing in the box foodstuff and beverages or catches.

Next, the picnickers go on a picnic carrying the constant temperature box containing therein foodstuffs and beverages and reach the resort, they release the hooks 81 and 82, remove the connecting portions 61 and 64 from the side wall 2 and those 62 and 63 from the side wall 4, and unfold all the side walls 2 through 5 with respect to the bottom 1, so that the unfolded walls and sheets are used as a carpet. In this case, the picnickers sit around the bottom wall carrying thereon the foodstuffs and beverages.

In a case where the box is stored when out of use, or carried when empty, the unfolded side walls 2 through 5 are not bulky to be stored or transported. In some cases, the side walls 2 through 5 are folded onto the bottom wall 1, thereby enabling to be not bulky when stored or transported.

In addition, the internal sheet 7 is not indispensable.

Figure 15:
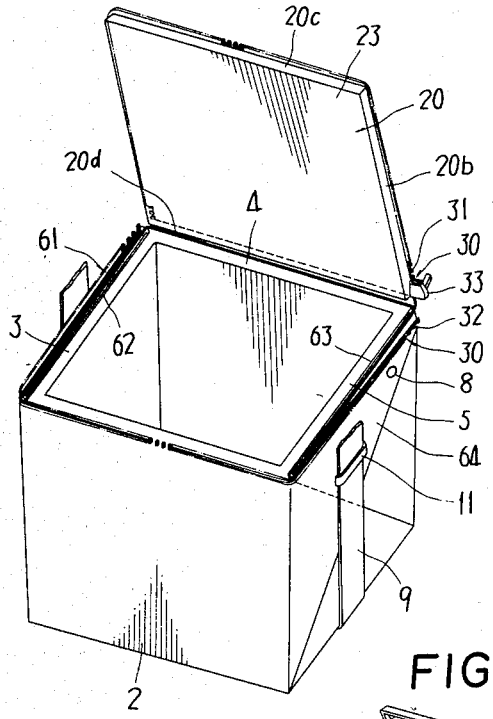
FIG. 15 is a perspective view of the box in assembly.

Alternatively, the lid 20 may, as shown in FIG. 15, be connected to one side edge of one side wall in relation of being open or closed.

Figure 13:
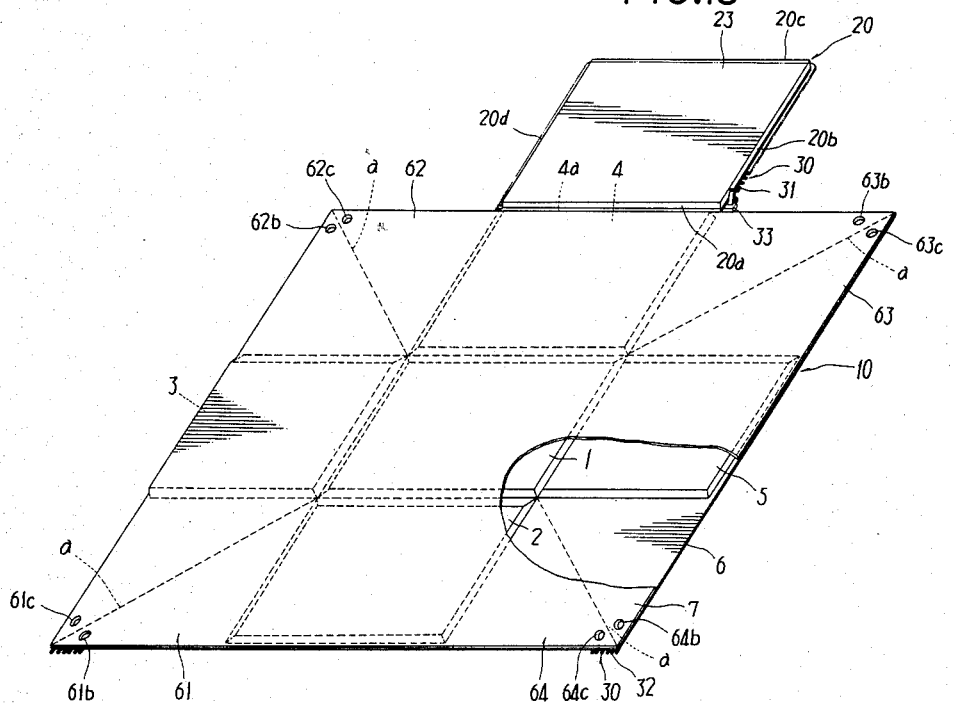
FIG. 13 is a perspective view of a modified embodiment of the constant temperature box of the invention, shown in unfolded condition.
Figure 14:
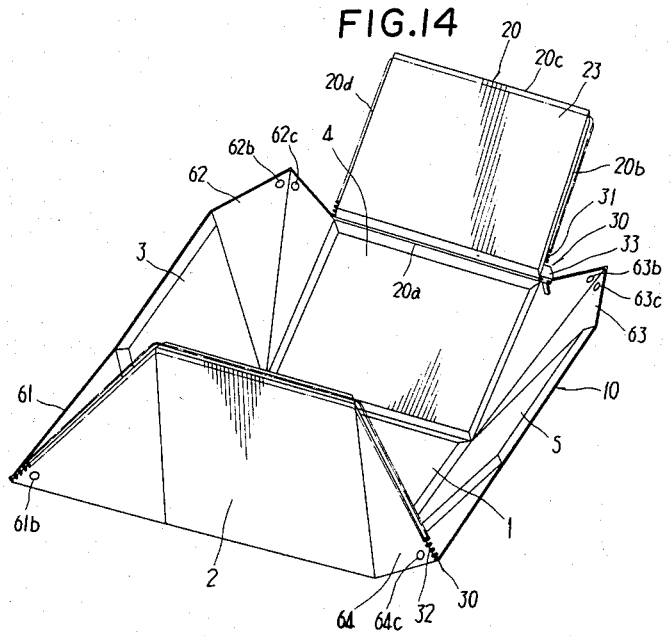
FIG. 14 is a perspective view of the FIG. 13 embodiment during assembly.

Referring to FIGS. 13 through 15, the square lid 20 of adiabatic material is connected at one edge 20*a* to one side edge 4*a* at side wall 4 in relation of opening and closing. Three edges 20*b*, 20*c* and 20*d* of lid 20, upper edge 2*a* of side wall 2 and side edges 61*a* and 64*a* at the connecting portions 61 and 64 at a side of side wall 2 are all provided with fasteners 30 respectively, thereby keeping the lid 20 closed by engagement of each fastener 30.

The side edges at connecting portions 61 and 64 to provide fasteners 30 are made about equal in length to the upper edges of side walls 3 and 5 adjacent to side wall 2, so that the terminal of each fastener 30, when the portions 61 and 64 is folded along the side walls 3 and 5, are positioned near the connection of lid 20 to the side wall 4.

The fasteners 30 each comprise a pair of first and second toothed bands 31 and 32 and a slider 33, the first toothed bands 31 being mounted by sewing or bonding to three side edges 20*b* through 20*d* of lid 20, the second bands 32 to the upper edge 2*a* of side wall 2 and edges 61*a* and 64*a* at connecting portions 61 and 64. The slider 33 is moved to engage the bands 31 with 32 to close the lid 20 and disengage the same to release the lid 20.

Also, the lid 20 is coated at both sides with an external sheet 23, which is utilized in part to connect the lid 20 to one side wall 2, 3, 4 or 5. Alternatively, the lid 20 may be connected to the side wall by use of a flexible band, or may previously be molded integrally with one side wall through a thin connector. Thus, the connecting means are not limited.

Next, explanation will be given of a modified embodiment of the invention shown in FIGS. 16 and 17.

Figure 16:
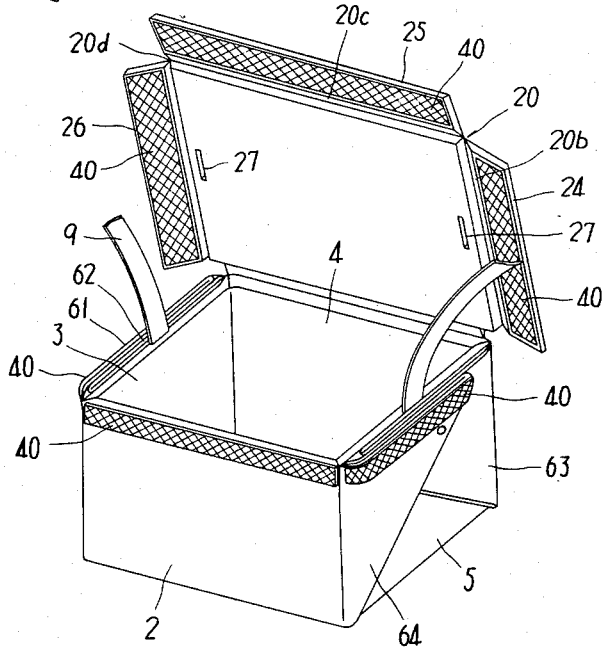
FIG. 16 is a perspective view of another modified embodiment of the invention, shown in assembled condition.

In FIG. 16, the lid 20 is connected at one side edge thereof to one side wall 4 and supports its other three side edges bendable and swingable walls 24, 25 and 26 respectively. Detachable adhesive tapes 40 are mounted to the inner surfaces of bendable walls 24, 25 and 26, to side wall 2 opposite to side wall 4, and the connecting portions 61 and 64 between the side wall 2 and those 3 and 5, thereby holding the lid 20 closed.

Figure 17:
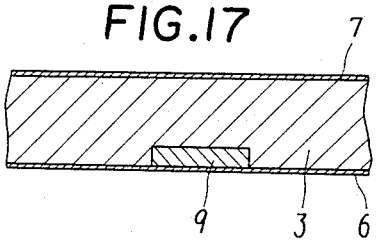
FIG. 17 is a partially enlarged sectional view of a side wall.

Also, the shoulder band 9 is mounted to the side walls 3 and 5 in an embedded manner as shown in FIG. 17, and the lid 20 has insertion bores 27 for band 9 as shown in FIG. 16.

As seen from the above, the constant temperature box of the invention can form the box body of the square bottom, four side walls and external sheet, the walls being unfolded or raised upright in order to be connected, thereby being more lightweight, inexpensive to produce, and not bulky to store or transport in comparison with the conventional one comprising inner and outer casings. Furthermore, it is very convenient to unfold each side wall to be used as one sheet.

Moreover, the connecting portions between side walls are made foldable, and the free ends folded at the connecting portions can be overlapped with each other at the opposite side walls. Through-bores coincident with each other are formed at the free ends, and the pair of connecting portions are detachably mounted to the opposite side walls by use of retainers to thereby hold each side wall upright, whereby a simple operation of retainers can hold the side walls upright or unfold them, thus enabling unskilled workers, salesmen or users, to assemble or unfold the box body with ease.

Although several embodiments have been described, they are merely exemplary of the invention and are not to be construed as limiting, the invention being defined solely by the appended claims.

What is claimed is:

1. A portable constant-temperature box comprising:

(a) a box body having a square bottom wall formed of adiabatic material and four side walls formed of adiabatic material and connected to four side edges of said bottom wall such that said walls can be unfolded and raised, (b) a lid formed of adiabatic material and supported to at least one of said side walls such that said lid can open and close with respect to said box body;

(c) a square external sheet connecting outer edges of said side walls, respective corners of said external sheet positioned between side edges of adjacent side walls forming connecting portions for connecting adjacent side walls respectively, said connecting portions being foldable triangularly so that first connecting portion free ends thereof folded at said connecting portions between said at least one side wall to which said lid is supported and a pair of side walls adjacent to said at least one side wall overlap second connecting portion free ends which are folded at connecting portions between another side wall opposite to said at least one side wall and a pair of side walls adjacent said another side wall, said first free ends overlapping said second free ends at said pair of side walls which are adjacent said at least one side wall, said first free ends being disposed between said second free ends and said pair of side walls adjacent said at least one side wall such that said first free ends are inside said second free ends in overlapped relationship; and (d) an elongated fastener comprising a slider and a pair of first and second band members each band member having engaging teeth, said slider being movable to engage and disengage said engaging teeth of said first and second bands with respect to each other to close and release said lid, said first band member being fixed along an entire length of three side edges of said lid, said three side edges each being other than a lid side edge through which said lid is supported to said at least one side wall, said second band member being fixed along an entire length of an upper edge of said another side wall opposite to said at least one side wall, said upper side edge being a highest edge of said another side wall when said another side wall is raised, said second band member also being fixed along an entire length of outer side edges of said connecting portions disposed between said another side wall and said pair of side walls adjacent said another side wall, said outer side edges being outwardly positioned when said connecting portions are folded.

* * * * *